United States Patent [19]

Nelson

[11] Patent Number: 4,643,054

[45] Date of Patent: Feb. 17, 1987

[54] QUICK SQUEEZE TOOL

[76] Inventor: Gary E. Nelson, 3304 Limerick, El Paso, Tex. 79925

[21] Appl. No.: 814,378

[22] Filed: Dec. 30, 1985

[51] Int. Cl.[4] ..... B25B 7/12

[52] U.S. Cl. ..... 81/352; 81/329; 81/333; 81/344

[58] Field of Search ..... 81/329, 331, 333, 338, 81/314, 344, 324, 352, 427.5, 486, 487; 254/28

[56] References Cited

U.S. PATENT DOCUMENTS

| | | | |
|---|---|---|---|
| 319,017 | 6/1885 | Payne | 81/352 |
| 1,373,683 | 4/1921 | Svebilius | 81/329 |
| 1,817,988 | 8/1931 | Klamt | 81/352 |
| 4,077,601 | 3/1978 | Dick | 81/331 |
| 4,575,049 | 3/1986 | Fister | 254/28 |

FOREIGN PATENT DOCUMENTS

| | | | |
|---|---|---|---|
| 2095605 | 10/1982 | United Kingdom | 81/333 |

*Primary Examiner*—Frederick R. Schmidt
*Assistant Examiner*—Bradley I. Vaught
*Attorney, Agent, or Firm*—Mack Casner

[57] ABSTRACT

Herein presented is a device for shutting off the flow through a pipe. The device is basically a pincers tool with two jaws and two handles. It, however, has special and unique features that make it rugged, reliable, efficient and easy to use.

It has compound leveraging. It has pivotal features that allow the inner surfaces of its jaws to remain parallel to one another as the jaws are opened and closed. A latching and releasing mechanism permits the locking of the handles once the jaws have reached a desired closed position.

4 Claims, 6 Drawing Figures

FIG. 1
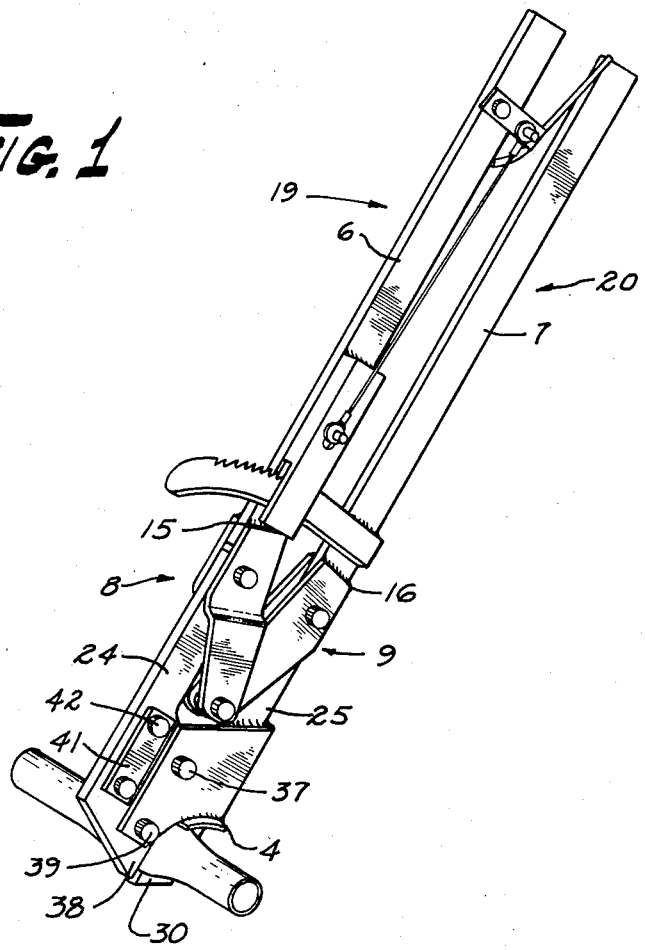
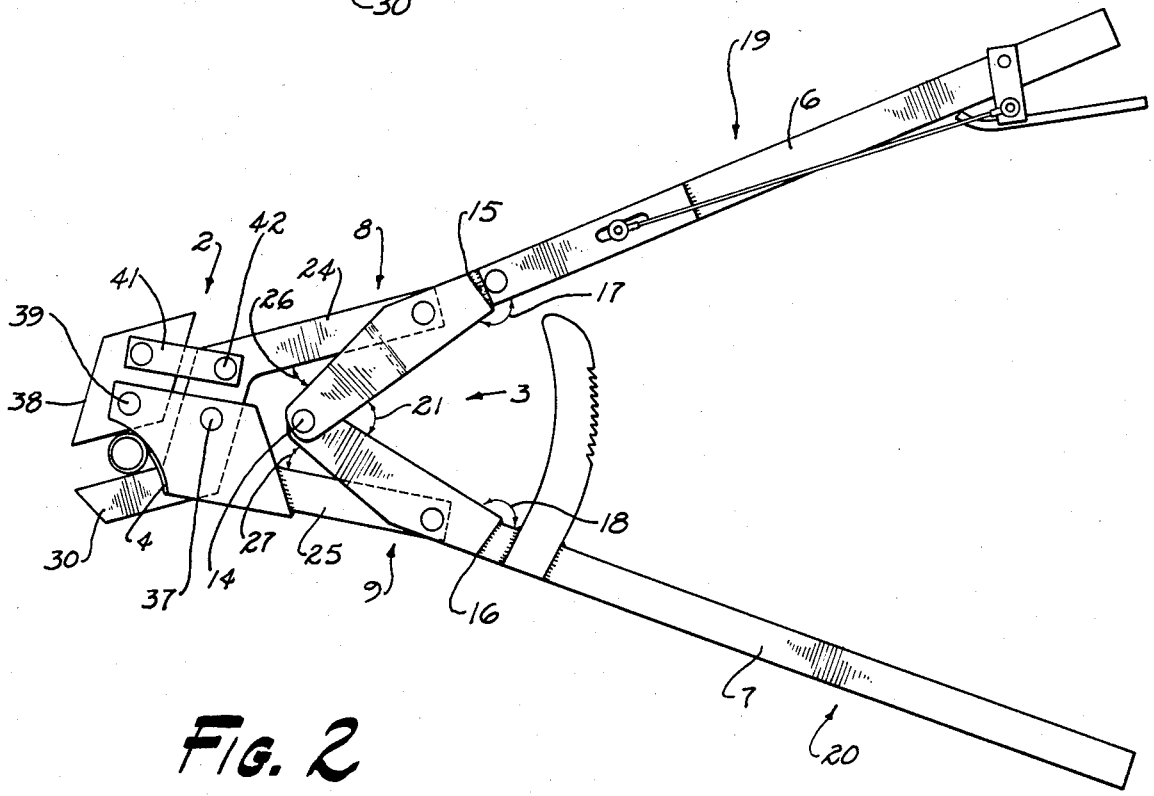
FIG. 2

QUICK SQUEEZE TOOL

BACKGROUND OF THE INVENTION

Materials used in the construction of pipes have become increasingly pliant and resilient. Various devices are being used to shut off the flow in pipes made with these more resilient materials. For portable devices for emergency shut off situations the pressure to squeeze the pipe closed is usually provided by either a screw or hydraulic action. The pipe is usually squeezed between two parallel bars. In most cases a wide area around the circumference of the pipe must be cleared of obstacles. In many situations and for many devices heavy and bulky equipment is required to provide adequate pressure to close the pipe. It appears that in many cases removing the pipe before applying the shut off would be more efficient and easy. Removing the pipe however defeats the purpose and is not practical nor possible in emergencies.

The device herein presented differs from those presently in use and is a needed improvement. The device provides pressure through compound leveraging instead of by means of a screw or hydraulics. The device employs a parallel jaws action instead of parallel bars. Thus it can be used without having to clear a wide area around the circumference of the pipe. There is no heavy and bulky equipment. The device can be readily carried and operated with two hands and takes up little storage space.

SUMMARY OF THE INVENTION

The invention is a pincer tool for the closure of pipes to shut off the flow through the pipes. The two handles of the pincer tool are each connected to two levers at a pivot point. One of the levers is connected to a jaw of the pincer tool at a pivot point. The other lever is connected at a pivot point to one of the levers that is connected to the other handle. This arrangement provides compound leveraging.

One of the jaws of the pincer has a movable part connected to it. This part is connected to the other jaw by means of an adjustment lever and it moves in unison with the other jaw. This permits an inner surface of a part of one jaw to remain parallel to a surface of the other jaw as the handles are opened and closed. An added feature consist of a latching and releasing mechanism for locking the handles once the desired closed position is attained.

BRIEF DESCRIPTION OF THE DRAWINGS

The invention can be better understood by examining the following in connection with the accompanying drawings, to wit:

FIG. 1 is an elevational view looking down on the complete device closed on a pipe.

FIG. 2 is a perspective view of one side of the complete device in an open position.

DESCRIPTION OF THE PREFERRED EMBODIMENT

Figure 3:
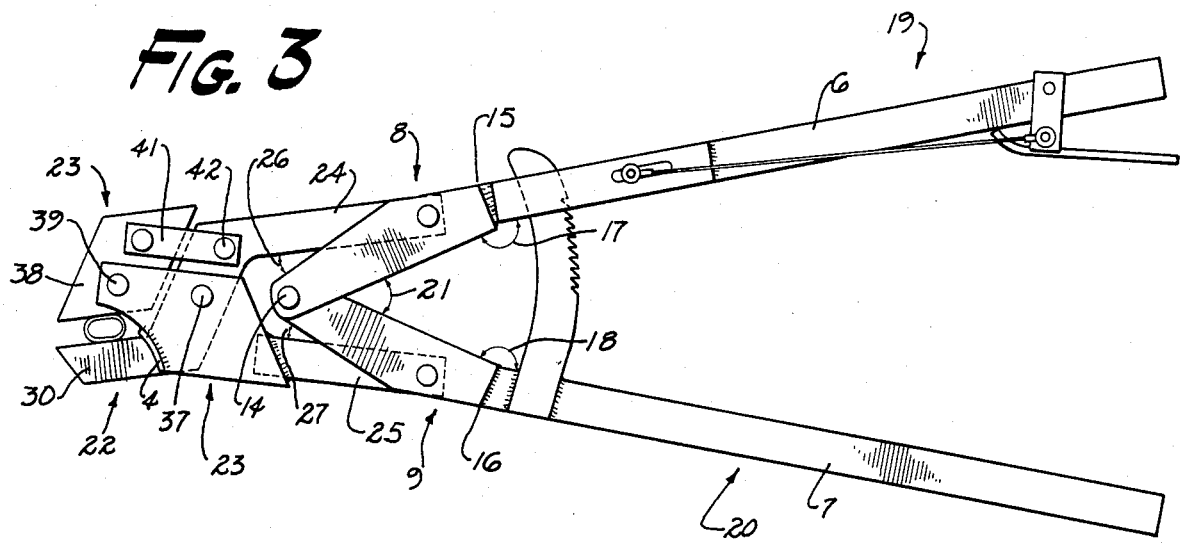
FIG. 3 is another perspective view of one side of the complete device but in a closing position.
Figure 4:
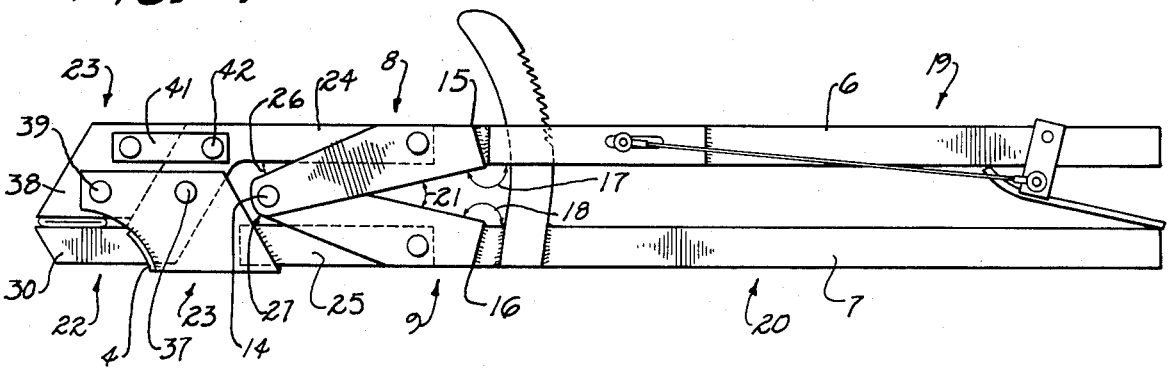
FIG. 4 is yet another perspective view of the one side of the complete device but here the device is closed on the pipe.
Figure 5:
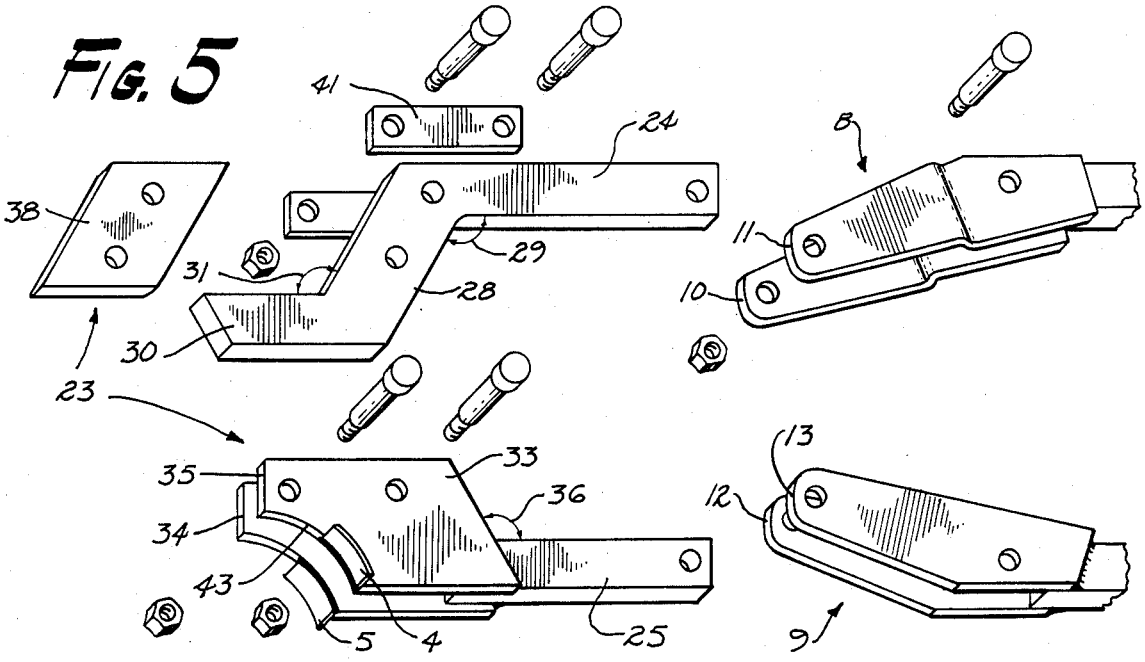
FIG. 5 is an exploded view of the jaws and the forked ends of the handles of the device.
Figure 6:
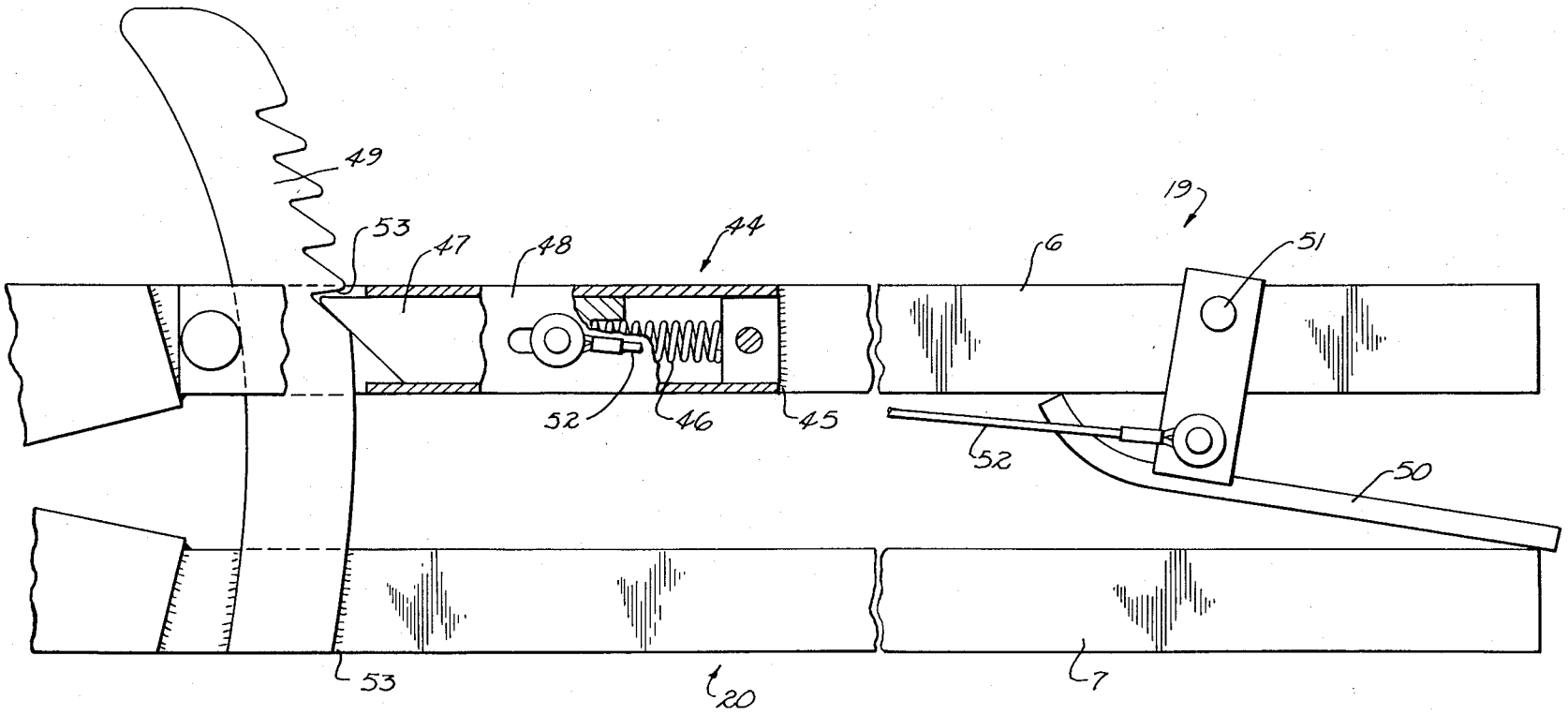
FIG. 6 is an exploded view of a latching and releasing mechanism.

Referring now to the drawings, the preferred embodiments of the invention herein consist of a pincer tool (1) with lever arrangements (2) and (3).

As shown the tool has two handles (6) and (7) and one end of each handle (8) and (9) is forked (10), (11), (12), and (13). These forked ends (10), (11), (12) and (13) are connected to one another at a point (14). The forked portion (8) and (9) of each handle (6) and (7) is at an angle (17) and (18) with the main body (19) and (20) of each handle (6) and (7) so that the handles (6) and (7) meet at the point (14). The ends (10), (11), (12), and (13) are attached to one another at the point (14) in a manner that permits angle (21) between the handles (6) and (7) to vary.

A jaw (22) and (23) is attached to each handle (6) and (7) at a point (15) and (16) where the handles (6) and (7) become forked and directed at an angle (17) and (18) from the main body (19) and (20) of each handle (6) and (7). The attached end portion of each jaw (22) and (23) is a lever (24) and (25). Each lever (24) and (25) forms an angle (26) and (27) with the forked portion (8) and (9) of each handle (6) and (7).

Jaw (22) has a midsection (28) that is at a 120° angle (29) with the lever end (24). Jaw (22) also has a tooth (30) at a 120° angle (31) with midsection (28) but on the opposite end of the midsection (28) from that of the lever end (24). The other jaw (23) has a midsection (33) that is forked and has forked portions (34) and (35) and its forms a 120° angle (36) with the jaws lever end (25). The midsection (28) of jaw (22) fits between the forked portions (34) and (35) of the midsection (33) and is attached (37) to the midsection (33) in a manner that allows the midsection (28) to rotate about this attachment point (37).

A piece (38) is attached at a point (39) to a corner end of midsection (33) and fitted between the forked portions (34) and (35) of the midsection (33). The piece (38) is the tooth of jaw (23) and its attachment allows rotation about the point of attachment (39). A lever (41) connects this piece (38) with jaw (22) at the intersection (42) of the lever end (24) and misection (28) of jaw (22). The other end corner (43) of the midsection (33) can have a concave curving.

A latching mechanism (44) consist of a spring (46) loaded pawl (47) within a housing (48) attached to the upper handle (6) at a point (45) and a curved rack (49) attached to the lower handle (7) at a point (53). For latching, the pawl (47) engages a notch (53) on the curved rack (49). A release handle (50) is pivotly connected to the upper handle (6) at a point (51) and is connected by a flexible cable (52) to the pawl (47). The latching mechanism (44) is released by exerting pressure on the release handle (50) to retract the pawl (47) and disengage it form one of the notches (53) on the rack (49).

The exact measurements of each part of the tool depends on the compound leveraging desired and the desired fit and closure of the teeth which in turn depends on the diameter of the pipes. While the invention has been shown and described with reference to the preferred embodiments thereof, it will be understood by those skilled in the art that various changes in form and details may be made therein without departing from the spirit and scope of the invention.

What is claimed is:

1. A pincer tool arrangement in this fashion: two handles, a first handle having one forked end which is at an angle to the main body of said first handle, a second handle having one forked end which is at an angle to the main body of said second handle, the forked end of said first handle intersects with the forked end of said second handle, the forked end of said first handle is attached to the forked end of said second handle at this intersection in such a manner that allows the angle between the said first handle and the said second handle to vary, a first jaw is attached to the said first handle at a point where the said first handle becomes forked, the end of said first jaw which is attached to the said first handle fits inside and goes between the said forked portions of said first handle, said first jaw is attached to said first handle in a manner that allows said first jaw to move in a plane, this plane is the same plane as the plane of the angle between the said first handle and the said second handle, a second jaw is attached to the said second handle at a point where the said second handle becomes forked, the end of said second jaw which is attached to the said second handle fits inside and goes between the said forked portions of said second handle, said second jaw is attached to said second handle in a manner that allows said second jaw to move in a plane, this plane is the same plane as the plane of the angle between the said first handle and the said second handle, the said first jaw has a first midsection which is at a 120° angle with the end of the said first jaw that is attached to the said first handle, this angle is in the same plane as the angle between the said first handle and the said second handle, the said second jaw has a second midsection which is forked and is at a 120° angle with the end of the said second jaw that is attached to the said second handle, this angle is in the same plane as the angle between the said first handle and the said second handle, the said first midsection attaches to, fits inside and goes between the forked portions of the said second midsection, the said first midsection is attached to the said second midsection in such a manner that allows the rotation of the said first midsection with respect to the said second midsection about the point of attachment, rotation is in the same plane as the angle between the said first handle and the said second handle, a first tooth is at the opposite end of the said first jaw from the end of the said first jaw that is attached to the said first handle, said first tooth is at a 120° angle with the said first midsection, this angle is in the same plane as the angle between the said first handle and the said second handle but it opens in the opposite direction than that of the angle between the said first handle and the said second handle, a second tooth fits into and is attached to a corner of the forked portions of the said second midsection, this corner is at the opposite end of the said second jaw from the end of the said second jaw that is attached to the said second handle, the said second tooth is attached to said corner of the forked portions of the said second midsection in a manner that would allow rotation of the said second tooth with respect to the forked portions of the said second midsection about the point of attachment, rotation would be in the same plane as the angle between the said first handle and the said second handle, a connection lever connects the said second tooth to the said first jaw at a point on the said first jaw where the said first midsection makes a 120° angle with the end of the said first jaw that is attached to the said first handle, a first end of the said connection lever is attached to the said first jaw in a manner that would allow the said connection lever to rotate with respect to the said first jaw about the point of attachment in the same plane as the angle between the said first handle and the said second handle if a second end of said connection lever was not also attached, the said second end of the said connection lever is attached to the said second tooth in a manner that would allow the said connection lever to rotate with respect to the said second tooth about the point of attachment in the same plane as the angle between the said first handle and the said second handle if the said first end of the said connection lever was not also attached, the said second tooth is thus attached directly to the said second jaw and attached by means of connection lever to the said first jaw, the said second tooth's rotation or movement is thus limited by and dependent on the movement of the said first jaw and the said second jaw, a side of the said second tooth will always be parallel to a side of the said first tooth.

2. A pincer tool arrangement as in claim 1 except in addition the forked midsection is so shaped to assist in exposing and positioning the teeth to satisfactorily fit the flatten cross section of a pipe of a desired diameter placed between the teeth.

3. A pincer tool arrangement as in claim 1 except in addition a latching mechanism consisting of a spring loaded pawl within a housing is attached to the said first handle and a curved rack is attached to the said second handle, said pawl engages a notch on the said rack for latching and a releasing mechanism consisting of a release handle is attached to the said first handle in a manner that allows said release handle to pivot with respect to the said first handle and is connected to the said pawl by a flexible cable, said handle is turned thus pulling the flexible cable which in turn disengages the said pawl from said notch on said rack.

4. A pincer tool arrangement as in claim 2 except in addition a latching mechanism consisting of a spring loaded pawl within a housing is attached to the said first handle and a curved rack is attached to the said second handle, said pawl engages a notch on the said rack for latching and a releasing mechanism consisting of a release handle is attached to the said first handle in a manner that allows said release handle to pivot with respect to the said first handle and is connected to the said pawl by a flexible cable, said handle is turned thus pulling the flexible cable which in turn disengages the said pawl from said notch on said rack.

* * * * *